US005095784A

United States Patent [19]

Garver

[11] Patent Number: 5,095,784

[45] Date of Patent: Mar. 17, 1992

[54] IMPACT-SPINNER WRENCH

[76] Inventor: Robert V. Garver, 12205 Greenridge Dr., Boyds, Md. 20841

[21] Appl. No.: 747,839

[22] Filed: Aug. 21, 1991

[51] Int. Cl.[5] ..... B25B 19/00

[52] U.S. Cl. ..... 81/466; 81/463

[58] Field of Search ..... 81/466, 463

[56] References Cited

U.S. PATENT DOCUMENTS 1,131,225 3/1915 Farkell ..... 81/466

4,759,242 7/1988 Andersson ..... 81/466

FOREIGN PATENT DOCUMENTS 2538473 3/1977 Fed. Rep. of Germany ..... 81/466

8702291 4/1987 World Int. Prop. O. ..... 81/466

*Primary Examiner*—Bruce M. Kisliuk

*Assistant Examiner*—Lawrence Cruz

*Attorney, Agent, or Firm*—Edwin E. Greigg; Ronald E. Greigg

[57] ABSTRACT

An impact-spinner wrench including a body assembly having driver impact members along a longitudinal bore, a shaft including output shaft nubs thereon that react with the driver impact members and an end that interacts with a socket. Oppositely disposed weighted handles extending from the body assembly and a handle for permitting rotation of the wrench without harm to the hands.

17 Claims, 1 Drawing Sheet

IMPACT-SPINNER WRENCH

BACKGROUND OF THE INVENTION

This invention relates to an impact-spinner wrench. Lugs on tires and bolts on engine heads as well as bolts in any situation ar frequently too tight for easy removal. Often the lugs holding a tire to a wheel drum have been tightened with a impact wrench by an overzealous mechanic overtightening them for good measure. The driver then may not be able to loosen the lugs when he is on the highway and has to change his tire. It is especially bad if the driver lacks upper body strength, as is common by virtue of age or sex. The same problem occurs when a home mechanic tries to rotate his own tires or to loosen bolts or nuts of other types. His resource is usually a manual lug wrench, socket wrench or end wrench in which he applies constant torque with the strength of his arms, which is sometimes not enough to loosen the lugs, bolts or nuts.

Another problem encountered by the home mechanic is in loosening bolts on the engine that have been in place for a long time. For example, the cylinder head bolts on an engine are highly torqued when installed. After they have been seated for many years, they tend to be "frozen" in. If constant torque is applied at ever increasing force, the bolts can be sheared by a twisting force. If, however, an impact torque force can be applied to them, the bolts can be broken loose due to the translated shock to the threads.

There is need for a simple and inexpensive manual impact wrench that the driver and home mechanic can purchase. And if it is built ruggedly enough, it could become a useful tool even for mechanics that may prefer not to bear the expense or inconvenience of an air driven impact wrench.

A cross-bar tire lug wrench gives a mechanic good leverage and is convenient in that it can be used to spin off the lugs. But it has a problem in that the stationary grip tends to slow it down since it must slip in the mechanic's hand. If it were optimized for spinning off lugs or nuts, it would have a hand grip with a bearing and more weight on the spinning ends. It would also have larger grips on the ends for a more comfortable fit to the hand.

A "manual" impact wrench is commonly available today that comprises a vertical shaft that is hit by a conventional hammer and the impulse is translated to torque by a cam arrangement at the socket end. This device may work well enough, but the area of the cam interface is small and subject to wear. It is distorted by repeated impacts to reduce the translated torque. And it does not have the feature of spinning, once the nut is loosened.

OBJECT AND SUMMARY OF THE INVENTION

The present invention provides a superior impact mechanism and superior spinning mechanism, all in one device.

An object of the present invention is to provide a manual impact wrench that provides high torque in pulses and allows for rapid removal and placement of nuts and bolts by a spinning action once they are loose. Special attention has been given to low cost, ease of assembly in manufacture, conservation of weight and material, translation of torque, endurance, storage size, human factors, ease of use, flexibility in use, and compatibility with existing accessories.

It is a further object of the present invention to provide an impact wrench to impart torque to frozen or overtightened nuts, studs, and bolts (lugs) to permit loosening them with minimal manual strength and without damaging the nuts, bolts or shafts of the studs due to high constant torque.

It is a further object to provide a means of rapidly removing or installing loose nuts and bolts by a spinning action.

It is a further object to provide a means of translating the impact energy of the free spinning arm to the driven socket with minimal loss of energy due to absorbing mechanisms in the necessary connecting parts which can be caused by play between the parts or springiness by intermediate members.

It is a further object to provide a simple and inexpensive structure that is easy to manufacture and assemble.

It is a further object to provide a device that is designed to fit human hands without surface having cutting or bruising edges and whose turning parts will not be impeded by friction in holding it.

It is a further object to provide a function that can be expanded and adapted using the presently existing inventory of socket wrench components.

It is a further object to provide a device that can switch between loosening and tightening without changing parts or throwing switches and which may be more readily understood by referring to the accompanying drawings.

DESCRIPTION OF THE PREFERRED EMBODIMENTS

Figures 1, 2, 3:
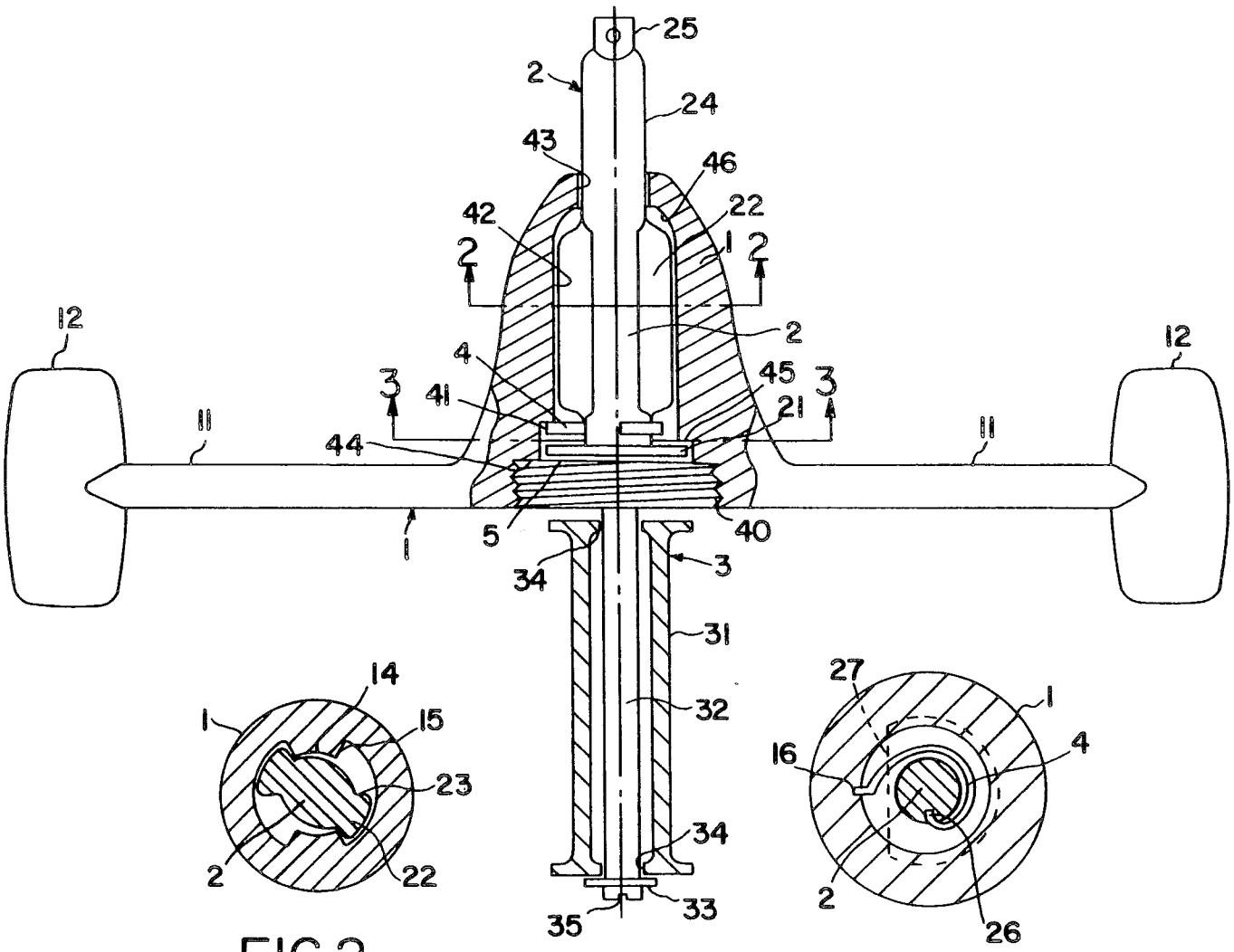
FIG. 1 is a plan view in elevation of the tool of the invention.
FIG. 2 is a sectional view of the impact translation mechanism along lines 2—2 of FIG. 1.
FIG. 3 is a sectional view of the pre-tension spring along lines 3—3 of FIG. 1.

Referring now to FIG. 1, the invention is shown as including a spinner housing assembly 1 which has two arms 11 and weighted handle grips 12 on each end. The spinner housing assembly 1 is provided with an enlarged central portion with an axial aperture formed with four different diameter portions 40, 41, 42 and 43 in order from the larger to the smaller diameter end. The outermost portion 40 forms shoulder 44, the next portion 41 forms shoulder 45, and the end portion forms a shoulder 46. The different diameter portion 42 is provided with two oppositely disposed inwardly extending driver members 14 each of which have wedged shaped surfaces with its inner face on circle. The largest diameter portion 40 is provided with threads to receive a spinner grip 3 including a shaft 32 that is threaded into the body of the spinning mechanism 1 and which extends from the arms 11. The arms 11 are elliptical in cross section providing strength in the rotational direction and minimizing weight. The housing of the impact mechanism is built up to provide strength in translating rotational energy from the rotating weights 12 to the impacting surfaces between the output shaft and the spinning mechanism.

The spinner grip assembly 3 comprises a spinner grip handle 31 which rotates on shaft 32 and which is retained on the shaft by a clip ring 33. Bearing surfaces 34 are provided on the inside of the spinner handle on each end thereof to minimize friction between the handle and the shaft 32.

An output shaft 2 includes a shoulder 21 between the end of the spinner grip 5 and the shoulder 45, which prevents the output shaft from movement out of the housing assembly 1 and which permits the shaft to spin relative to the housing assembly 1. The shaft 2 includes an end 24 that extends from the end 43 of the axial aperture. The shaft end that extends from the end 43 is substantially the same diameter in size as the end opening 43 so that the opening 43 forms a bearing for the shaft. Between the small end 43 of the housing assembly 1 and the shoulder 45, the shaft 2 is provided with output shaft nubs 22 which extend juxtaposed the wall of the aperture portion 42 and between the driver members 14. The output shaft nubs 22 are formed with their outer face along opposite segments of a circle. The nubs 22 have the shape of a truncated wedge with the wider portion juxtaposed the wall of the aperture portion 42 of the housing assembly 1. The slope of the faces of the shaft nubs 22 and the driver members 14 have the same angle so that they contact each other along the entire facial surface during use. The shaft nubs and driver members are formed such that their faces are on an angle of approximately 60 degrees therefore, the shaft can rotate within the housing assembly 1 for a distance of about 60 degrees. During rotation of the shaft 2 within the housing assembly the surfaces 23 of the shaft nubs function as an anvil in the impact action and the surfaces 15 on the driver members function as the hammers. The shaft nubs 22 and driver members 14 are symmetrically disposed to prevent unbalanced forces from being translated to the output shaft which can dissipate impact energy and contribute to unneeded wear.

As can be seen from FIG. 1 the area of engagement between the hammers and anvils is substantial in that the surfaces are several inches long along the shaft and match equally sized surfaces on the spinning mechanism. This large area of contact between the hammers and anvils contributes to efficient translation of impact energy and long life of the surfaces. The corners at the juncture between the hammers and anvils and their adjacent round surfaces are curved to prevent high stress from abrupt right angles at those locations.

The outer end of the shaft 2 is formed to fit an end of a ½ inch socket and the shank 24 of the output shaft is kept short and stout to prevent absorption of the high frequency energy of the impact pulse, said high frequency components being the major contributors to the force multiplication of the impact action. The rotational inertia of the output shaft assembly 2 is also kept at a minimum in order to minimize the loss of energy in making the shaft move. This is accomplished by keeping its radius to a minimum and can even be improved by having thin material in the area of the flange 21. Other means of reducing the rotational inertia of the output shaft may be used by removing material to optimize inertia and strength, but the gains are not significant over what can be achieved with a simple solid structure.

The length of the output shaft shank 24 is optimized. It should be long enough to provide the desired length so that extensions are not needed for most applications. It should be long enough to allow easy gripping of the socket for removal. It should be as short as possible to prevent absorption of impact energy due to torque spring action in the shaft.

The ½" square drive 25 provided at the end of the output shaft is to accept the wide range of heavy duty sockets and extensions commonly used in mechanical work.

FIG. 3 shows the details of a pretension spring 4. The pretension spring snaps into a slot 26 in the output shaft 2 next to the flange 21. It is placed on the shaft before the shaft is inserted in the impact chamber 42 by sliding it over the ½" square drive end. The other end of the spring is inserted into the slot 16 in the housing assembly 1. The shaft end of the spring is crimped slightly so that it must be pressed into slot 26 for retention. In the rest state, the spring causes the output shaft nubs 22 to be centered between the driver members 14 on the spinning mechanism 1.

The function of the spring is to deliver a slight torque to the entire drive train to take out slack before the impact of the drive mechanism occurs. The drive train typically comprises the socket being used or extensions used with it. The interfaces are between the ½" square drive and the socket and between the socket and the nut or bolt being driven. Without the spring, the impact would be transferred in a momentum transfer chain causing multiple bounces of progressively closer proximity in time and of lesser amplitude than the direct transient. Taking out the slack before the impact conserves high frequency energy in the impact pulse and also reduces impact wear on the various interfaces. These interfaces have slack by design in order to allow the socket to be snapped on and the socket to slide over the nut or bolt. By pretensioning the drive train, the pulse energy is delivered to the nut or bolt being driven and to the weakest interface, which is hopefully, the threads.

The spring 4, by virtue of centering the output shaft nubs, provides the same torque action before the impact for either direction of travel of the spinning mechanism. It does not require any switches to be thrown or parts to be removed and replaced to change direction between loosening and tightening nuts or bolts.

As a spinner wrench, the weights of the handle grips serve as a transfer mechanism from spinning energy imposed by hand thrust. Their relatively large mass allows more accelerational energy to be imparted to the spinning mechanism by a hand thrust in that the larger mass resists acceleration by the hand and more force can be applied. The thus stored rotational energy then keeps the wrench spinning longer and more able to overcome friction of a tight thread for a longer time.

In the impact mode, the handle 11 and weights 12 are thrust in a rotational direction by motion of the mechanic's hand The pretensioning spring 4 takes the slack out of the drive train. And then the hammers 15 engage the anvils 23 imparting an impulse torque to the output shaft 24. The housing assembly or spinning mechanism 1 rebounds from the impact, spinning the mechanism in the opposite direction. The mechanic then applies pressure again to the handle 11 and weights 12 and the cycle is repeated periodically until the nut or bolt is loose. The action of the mechanic is to keep the spinning mechanism bouncing against the anvils of the output shaft. Once the nuts or bolts are loose there is no more bounce and the mechanic gives a handle 11 a better thrust causing the nut or bolt to spin off.

The wrench as described is easy to fabricate and assemble The more complex and stronger components are the spinner assembly, output shaft, and spinner handle shaft. These three items are easily fabricated in production using conventional forged steel methods. The other items are minor parts, the spinner handle grip is easily fabricated using molded plastic and the spring by a spring bending apparatus.

In assembly, the spring is first slipped over the output shaft from the output end and forced into its slot in the shaft. The output shaft is then inserted into the chamber in the spinner mechanism from the largest diameter end toward the smallest diameter end and the end of the spring seated in its recessed notch in the spinner mechanism by pressing in the open area provided in the flange of the output shaft. This open area is shown by the dotted shape (27) in FIG. 3. The output shaft is then captured by screwing in the handle shaft 32 until it seats. The handle shaft has a slot 35 on the user end for screwing with a screwdriver and it has notches at its base that allow for tightening by tapping a screwdriver with a hammer. The handle 31 is then slid over its shaft 32 and retained by a conventional clip ring 33 on the user end. The tool can be disassembled in the reverse order, not necessarily removing the spinner handle from its shaft nor removal of the spring from the shaft 2.

It is understood that more momentum arms can be added to the structure as long as they are equally spaced around the axis, however, having only two arms provides for easy storage of the impact-spinner wrench in a conventional tool box.

It is also understood that the tool can be made to a smaller scale to permit frozen nuts in smaller spaces to be broken loose and in the more restricted space the spinner handle and degree of freedom may be smaller to permit working in the smaller space. For example in removing brake parts, one arm may be satisfactory and movement of the shaft through 30 degrees may be best. It might be more convenient to use $\frac{3}{8}''$ or $\frac{1}{4}''$ drive and sockets. The shaft may be made for any desired size socket and the shafts interchanged if desired. The facets of this invention that are retained and useful are the long-life and efficient engagement area between the hammers and anvils, and the pretensioning spring.

While the tool shown is a working concept of the invention, it is understood that various modifications and variations in its configuration may be resorted to without departing from the spirit and scope of the device as herein shown.

What is claimed and desired to be secured by Letters Patent of the United States is:

1. An impact-spinner wrench assembly which comprises a housing assembly (1), oppositely disposed arms (11) extending from a hub of said housing assembly, a weighted handle grip (12) secured to each of said oppositely disposed handles, an axially disposed bore in said housing assembly, said axially disposed bore having different diameter bore portions which form different diameter shoulders, an outer bore portion (40) having screw threads thereon, an inner bore portion (42) including oppositely disposed elongated inwardly directed radial driver members (14), an output shaft (2), said output shaft including a shoulder (21) on one end, oppositely disposed elongated outwardly directed radial shaft nubs (22) disposed along a portion thereof and an output shaft shank (24) that extends from said housing assembly (1), said output shaft shank including an end portion shaped to fit a socket tool, a spinner handle assembly secured to said threaded outer bore portion of said housing assembly against a first shoulder, said shoulder (21) of said output shaft lying between said spinner handle assembly and said first shoulder, and said output shaft nubs (22) on said shaft (2) are positioned within said housing assembly bore along said driver members (14) on said inner portion of said bore and are of the same length as said driver members (14), and the arms and the output shaft have dimensions which are minimized to facilitate storage in conventional tool chests.

2. An impact-spinner wrench as set forth in claim 1, in which, said output shaft nubs (22) and said driver members (14) are juxtaposed the output shaft shank (24) to minimize loss of torque impact energy.

3. An impact-spinner wrench as set forth in claim 1, in which, said output shaft nubs (22) and said driver members (14) are of comparable dimension to provide equal stress on each and to provide approximately 30–60 degrees of freedom for impact motion.

4. An impact-spinner wrench as set forth in claim 1, in which, the hub of said housing assembly (1) is built up in conical fashion to provide strength and efficient translation of impact energy from said weighted handle grips (12) to said output shaft (24).

5. An impact-spinner wrench as set forth in claim 2, in which, said output shaft nubs and driver members define large areas of contact therebetween to minimize wear and provide for efficient transfer of impact energy from the housing assembly (1) to the output member (2).

6. An impact-spinner wrench as set forth in claim 1, in which, the output shaft nubs are symmetrically disposed.

7. An impact-spinner wrench as set forth in claim 1, which includes, a spring means pretensions the drive components.

8. An impact-spinner wrench as set forth in claim 1, in which, the output shank (24) is short and stout to conserve impact energy and provide for convenience in storage.

9. An impact-spinner wrench as set forth in claim 1, in which, the different diameter bores (40, 41, 42, 43) are staged in descending order of internal magnitude toward the shaft end so as to facilitate fabrication and assembly.

10. An impact-spinner wrench as set forth in claim 1, in which, said spinner handle assembly includes, a shaft having a threaded end, slotted screw means disposed in an outside surface of said threaded end at the base for tightening and loosening with a conventional screw driver and hammer, a spinner handle (31) of said spinner handle assembly is provided with low friction bearing surfaces at opposite ends, a conventional clip ring (33) for attachment of said spinner handle.

11. An impact-spinner wrench as set forth in claim 7, in which, the arrangement of output shaft drive members (22), nubs (14), and spring means (4) allows the wrench to be reversible in operation.

12. An impact-spinner wrench as set forth in claim 1, in which, a terminal portion (25) of said output shaft shank (24) is provided for use with conventional sockets and accessories.

13. An impact-spinner wrench as set forth in claim 1, in which, the arms and the output shaft have dimensions which are minimized to facilitate storage in conventional tool chests.

14. An impact-spinner wrench as set forth in claim 1, in which, said output shaft nubs and said driver members are disposed internally of said housing assembly for impact to keep them clean and to avoid potential injury to users.

15. An impact-spinner wrench as set forth in claim 4, in which, a bore portion of a small end of said housing assembly functions as a bearing surface for said output shaft.

16. An impact-spinner wrench as set forth in claim 7, in which, a bore portion of a small end of said housing assembly functions as a bearing surface for said output shaft.

17. An impact-spinner wrench as set forth in claim 7, in which, said end portion of said shank is formed to fit a socket tool having a size selected from the group consisting of ½ inch, ⅜ inch and ¼ inch, as well as comparable metric socket tools.

* * * * *